US009771697B2

(12) United States Patent
Rong

(10) Patent No.: US 9,771,697 B2
(45) **Date of Patent: *Sep. 26, 2017**

(54) PET WASTE COLLECTOR

(71) Applicant: Kebin Rong, Alhambra, CA (US)

(72) Inventor: Kebin Rong, Alhambra, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/259,016

(22) Filed: Sep. 7, 2016

(65) Prior Publication Data

US 2017/0009415 A1 Jan. 12, 2017

Related U.S. Application Data

(63) Continuation of application No. 14/797,169, filed on Jul. 12, 2015, now Pat. No. 9,469,950.

(51) Int. Cl.
*A01K 29/00* (2006.01)
*E01H 1/12* (2006.01)

(52) U.S. Cl.
CPC ... *E01H 1/1206* (2013.01); *E01H 2001/1226* (2013.01)

(58) Field of Classification Search
CPC ..... E01H 1/1206; E01H 2001/1226; A01K 23/005; A01K 1/0107; A61F 13/105; A41D 13/08; A41D 13/081; A41D 19/015; A41D 2600/20; A41D 19/0055; A41D 19/01505; A61B 19/04
USPC ..... 294/1.3; 2/16, 20, 59, 161.6, 161.7
See application file for complete search history.

(56) References Cited

U.S. PATENT DOCUMENTS 4,788,733 A * 12/1988 Lerner ..... A47L 13/19 15/104.94
5,186,506 A * 2/1993 Gale ..... E01H 1/1206 294/1.3
5,222,777 A * 6/1993 Clonch ..... E01H 1/1206 294/1.3
7,216,905 B1 * 5/2007 Armes, Jr. ..... E01H 1/1206 294/1.3
2009/0315350 A1 * 12/2009 Allen ..... E01H 1/1206 294/1.3
2010/0084880 A1 * 4/2010 Avilez ..... E01H 1/1206 294/1.3
2010/0176611 A1 * 7/2010 Merino-Garcia ..... E01H 1/1206 294/1.3
2011/0210571 A1 * 9/2011 Dan ..... A41D 19/0024 294/1.3

* cited by examiner

*Primary Examiner* — Stephen Vu
(74) *Attorney, Agent, or Firm* — Raymond Y. Chan; David and Raymond Patent Firm

(57) ABSTRACT

A pet waste collector includes a bag body and a waste collecting apparatus. The bag body, which is made of flexible material, has a top opening and a waste collecting cavity. The waste collecting apparatus includes two elongated scraper arms spacedly affixed at the bag body to partition the bag body into a first bag portion and a second bag portion. When the bag body is reversibly flipped inside out from the top opening to form a temporary waste cavity within the first bag portion of the bag body, the scraper arms are moved toward each other for enclosing the temporary waste cavity within the first bag portion of the bag body and for scraping a pet waste within the temporary waste cavity. Therefore, the bag body is flipped back for automatically retaining the pet waste in the waste collecting cavity from the temporary waste cavity.

19 Claims, 3 Drawing Sheets

PET WASTE COLLECTOR

CROSS REFERENCE OF RELATED APPLICATION

This is a Continuation application that claims the benefit of priority under 35 U.S.C. §120 to a non-provisional application, application Ser. No. 14/797,169, filed Jul. 12, 2015, which has been issued as U.S. Pat. No. 9,469,950, dated Oct. 18, 2016. The afore-mentioned patent applications are hereby incorporated by reference in their entireties.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a pet waste bag, and more particular to a pet waste collector, which provides two scraper arms at the bag body for scraping pet wastes into the bag body.

Description of Related Arts

Dogs tend to excrete while they are walked. It is the duty of the dog's owner to clean up the dog's fecal waste in private or public areas. One of the most important responsibilities is to pick up the fecal waste when they are walking their pets in a public place. In addition, many countries have laws and regulations that require pet's owners to pick up their pet's fecal waste. Otherwise, the pet's owners may receive citations. However, once the fecal wastes fall on the ground or grass, it is difficult to collect them completely.

Most pet's owners carry a pet waste bag in order to pick up and collect the waste. There are many different bag dispensers in the market for the pet's owner to carry the pet waste bags during walking the pet. However, the pet waste bag has several drawbacks. In order to pick up the waste on the ground or grass, the pet's owner will usually insert one hand into the pet waste bag and scoop the waste by the hand into the pet waste bag. It is a chore for the pet's owner to pick up the waste by hand even though the hand is covered by the pet waste bag. Most of the pet's owners feel totally disgusting when gripping or touch the waste by hand. Furthermore, the size of the pet waste bag is usually way larger than the hand size of the pet's owner. It is a waste to collect small amount of waste in a big bag. If the size of the pet waste bag is reduced, the hand of the pet's owner is hard to insert into the pet waste bag. Even though the hand of the pet's owner fits into the pet waste bag, the pet waste bag is difficult to flip inside out with the hand therein after picking up the waste. In addition, the pet waste bag is easily dirty when picking up the waste. As a result, the hand of the pet's owner will eventually get dirty when tying up the pet waste bag.

A picking tool is provided in the market to pick up the waste from the ground into the pet waste bag, such that the pet's owner does not have to scoop the waste by his or her own hand. The picking tool generally comprises a handle and a scooping head such that the pet's owner can grip the pet waste bag by one hand and hold the handle by another hand to scoop the waste by the scooping head into the pet waste bag. In other words, the pet's owner requires both hands to complete the waste collecting process. It is inconvenient for the pet's owner since the pet's owner must grip the pet leash by one hand. Thus, the pet's owner must carry the dirty picking tool after the use thereof.

SUMMARY OF THE PRESENT INVENTION

The invention is advantageous in that it provides a pet waste collector, which provides two scraper arms at the bag body for scraping pet wastes into the bag body.

Another advantage of the invention is to provide a pet waste collector, wherein two scraper arms are symmetrically arranged on two opposed sides of the bag body respectively to scrap the waste into the bag body.

Another advantage of the invention is to provide a pet waste collector, wherein each of the scraper arms has serrated edge for enhancing the scraping operation of the waste.

Another advantage of the invention is to provide a pet waste collector, wherein the top opening of the bag body is always kept clean during the collecting process.

Another advantage of the invention is to provide a pet waste collector, wherein the scraper arms can be operated via a scraping actuator which is detachably coupled with the scraper arms, such that the user is able to re-use the scraping actuator to other bag body with the built-in scraper arms.

Another advantage of the invention is to provide a pet waste collector, wherein the size of the bag body can be minimized to collect the waste, so as to minimize the material waste of the bag body.

Another advantage of the invention is to provide a pet waste collector, wherein manufacturing process of the pet waste collector is simple and easy by affixing the scraper arms at the surface of any pet waste bag. In other words, the scraper arms can be incorporated with any existing pet waste bag without altering the original structure thereof.

Another advantage of the invention is to a pet waste collector, wherein the user is able to easily complete the waste collecting process by one hand.

Another advantage of the invention is to provide a pet waste collector, wherein no expansive and complicated structure is required to be employed in the present invention in order to achieve the above mentioned objects. Therefore, the present invention successfully provides an economic and efficient solution that allows the user easily pick up and collect the waste without touching the waste by the user hand.

Additional advantages and features of the invention will become apparent from the description which follows, and may be realized by means of the instrumentalities and combinations particular point out in the appended claims.

According to the present invention, the foregoing and other objects and advantages are attained by a pet waste collector, comprising a bag body and a waste collecting apparatus.

The bag body, which is made of flexible material, has a top opening and a waste collecting cavity.

The waste collecting apparatus comprises two elongated scraper arms spacedly affixed at the bag body to partition the bag body into a first bag portion between the scraper arms and a second bag portion as the rest portion of the bag body. When the bag body is reversibly flipped inside out from the top opening, the scraper arms are moved toward each other to form a temporary waste cavity within the first bag portion of the bag body for scraping a pet waste within the temporary waste cavity. Therefore, the bag body is flipped back for automatically retaining the pet waste in the waste collecting cavity from the temporary waste cavity.

In accordance with another aspect of the invention, the present invention comprises a method for collecting pet waste by a pet waste collector, comprising the following steps.

(1) Provide a bag body with two elongated scraper arms which are spacedly affixed at the bag body and located away from the top opening to partition the bag body into a first bag portion between the scraper arms and a second bag portion as the rest portion of the bag body.

(2) Reversibly flip the bag body inside out from the top opening to form a temporary waste cavity within the first bag portion of the bag body.

(3) Scrape the pet waste by moving the scraper arms toward each other so as to collect the pet waste within the temporary waste cavity.

(4) Flip the bag body back for automatically retaining the pet waste in the waste collecting cavity from the temporary waste cavity.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
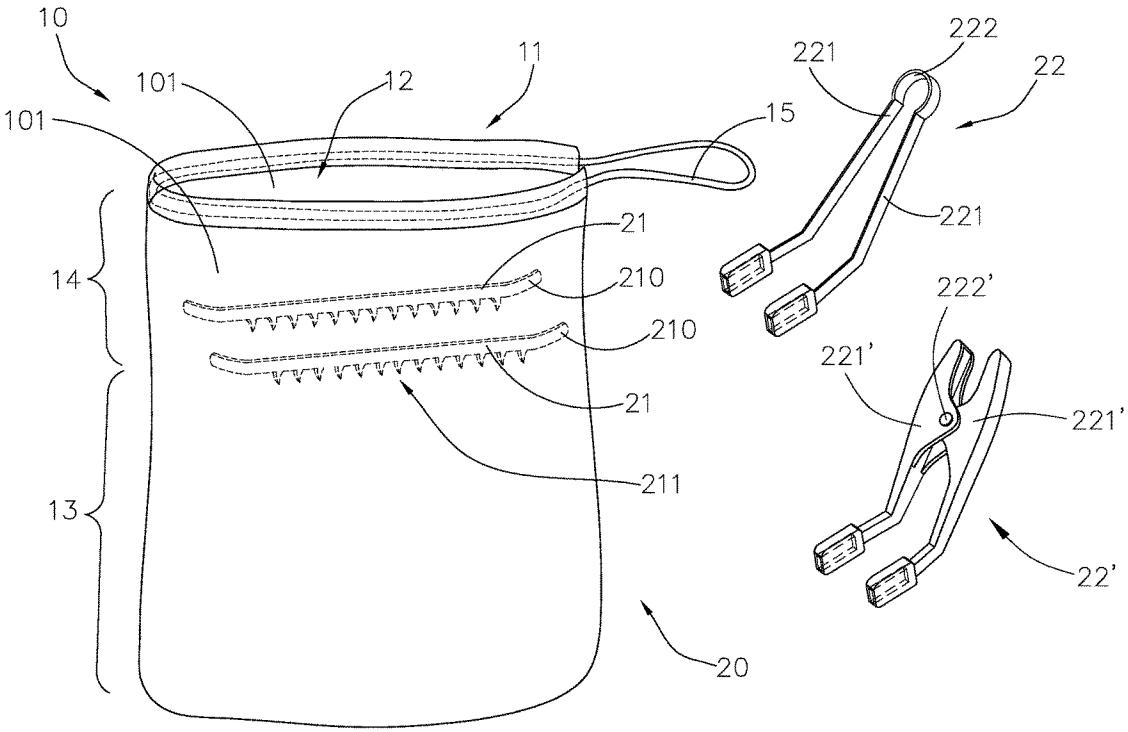
FIG. 1 is a perspective view of a pet waste collector according to a preferred embodiment of the present invention.
Figure 2:
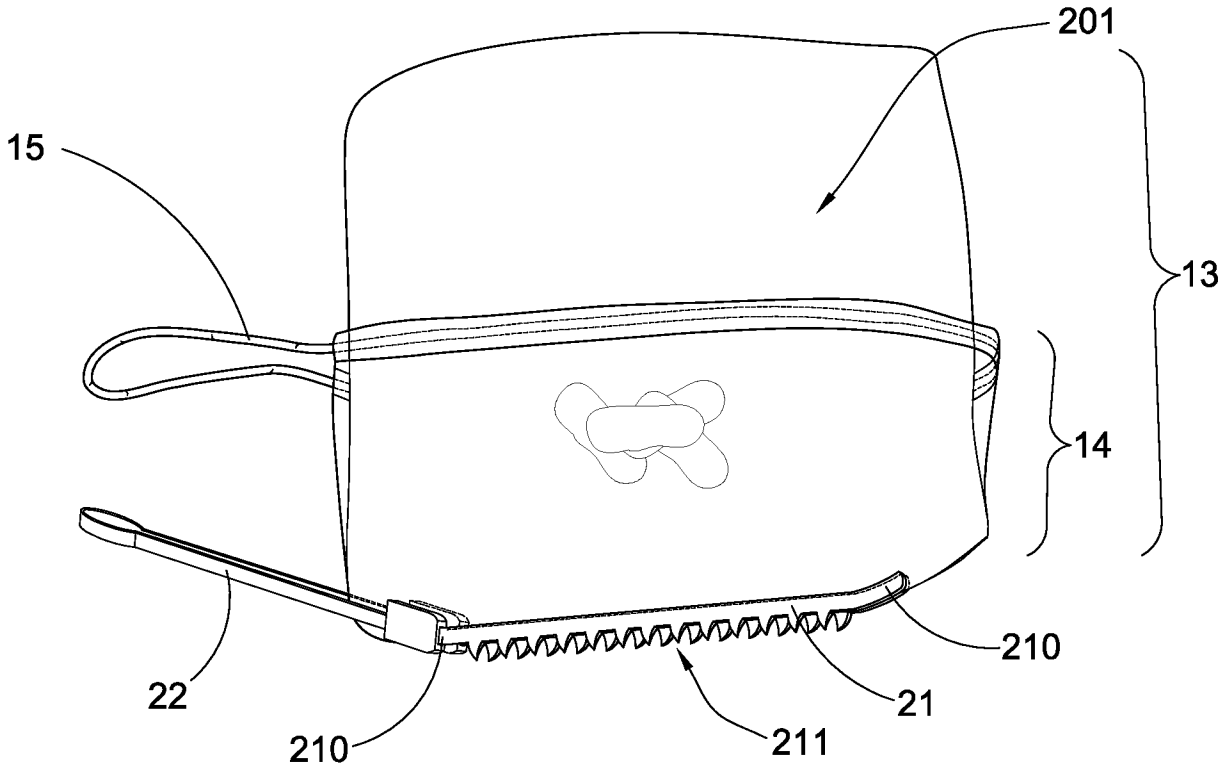
FIG. 2 is a sectional view of the pet waste collector according to the above preferred embodiment of the present invention, illustrating the bag body reversibly flipped inside out from the top opening to form the temporary waste cavity.

Referring to FIGS. 1 and 2 of the drawings, a pet waste collector according to a preferred embodiment of the present invention is illustrated, wherein the pet waste collector comprises a bag body 10 for collecting a waste and a waste collecting apparatus 20 for picking the waste into the bag body 10.

The bag body 10, which is made of flexible material, has a top opening 11 and a waste collecting cavity 12. Preferably, the bag body 10 is made of biodegradable plastic adapted to be decomposed.

As shown in FIG. 1, the bag body 10 comprises two bag sheets 101 overlappedly with each other to form the waste collecting cavity 12 between the bag sheets 101. The bag sheets 101 can be formed by two individual sheets affixed with each other edge-to-edge, or can be formed by one single sheet overlappedly folded in half. For example, each of the bag sheets 101 has a rectangular shape, wherein three edges of the bag sheets 101 are sealed correspondingly while one of the edges of each bag sheet 101 is remained unsealed to form the top opening 11 of the bag body 10. It is appreciated that the bag body 10 can be configured to have different sizes and different shapes as long as the bag body 10 is large enough to collect the waste, i.e. the pet waste. Preferably, the width of the bag body 10 is not larger than an opening size of the top opening 11 thereof. In other words, the opening size of the top opening 11 of the bag body 10 should equal to or larger than the width of the waste collecting cavity 12 of the bag body 10.

The waste collecting apparatus 20 comprises two elongated scraper arms 21 spacedly affixed at the bag body 10 to partition the bag body 10 into a first bag portion 13 and a second bag portion 14. The first bag portion 13 of the bag body 10 is a portion defined between the scraper arms 21. The second bag portion 14 of the bag body 10 is defined at the rest portion thereof.

As shown in FIG. 1, the scraper arms 21 are affixed at the bag sheets 101 respectively. In particular, the scraper arms 21 are symmetrically affixed at inner sides of the bag sheets 101 respectively. Preferably, the scraper arms 21 can be affixed on the inner sides of the bag sheets 101 respectively by ultrasonic connection or adhesive. The scraper arms 21 are made of rigid material stiffer than the bag body 10. For example, the scraper arms 21 can be made of plastic, preferably biodegradable plastic.

In addition, the scraper arms 21 are identical and parallel with each other. More importantly, the scraper arms 21 are affixed to the bag body 10 with a distance away from the top opening 11 thereof. Preferably, the scraper arms 21 are affixed to the one-third of the bag body 10 from the top opening 11 thereof. The scraper arms 21 are also parallel to the top opening 11 of the bag body 10.

Accordingly, each of the scraper arms 21 is configured to form a strip, wherein a longitudinal length of each of the scraper arms 21 is smaller than the width of the bag body 10. It is worth mentioning that the longitudinal length of each of the scraper arms 21 can be maximized via the width of the bag body 10 to enhance the scraping operation of the scraper arms 21.

As shown in FIGS. 1 and 2, each of the scraper arms 21 has a serrated shape, wherein each of the scraper arms 21 has a plurality of scraping teeth 211 formed along a longitudinal edge thereof for further enhancing the scraping operation when the scraper arms 21 are moved toward each other. Accordingly, the scraping teeth 21 of each of the scraper arms 21 are pointing toward a bottom of the bag body 10, i.e. away from the top opening 11 thereof. Preferably, each of the scraping teeth 21 has a curved shape, as shown in FIG. 2, to serve as a clawing tooth to scrape the pet waste when the scraper arms 21 are moved toward each other. In particular, the scraping teeth 21 at one scraper arm 21 are misaligned with the scraping teeth 21 at another scraper arm 21, such that when the scraper arms 21 are moved toward each other, the scraping teeth 21 at one scraper arm 21 are alternating with the scraping teeth 21 at another scraper arm 21. In other words, the scraping teeth 21 at one scraper arm 21 are engaged with the gaps between the scraping teeth 21 at another scraper arm 21.

As the bag body 10 is partitioned by the scraper arms 21, the first bag portion 13 of the bag body 10 is formed at the bottom portion thereof between the scraper arms 21 and the bottom side of the bag body 10 as shown in FIG. 1. The second bag portion 14 of the bag body 10 is formed at the upper portion thereof between the scraper arms 21 and the top opening 11 of the bag body 10 as shown in FIGS. 1 and 2.

According to the preferred embodiment, when the bag body 10 is reversibly flipped inside out from the top opening 11 to the scraper arms 21, the second bag portion 14 of the bag body 10 is overlapped with and covered by the first bag portion 13, as shown in FIG. 2, to form a temporary waste cavity 201 within the first bag portion 13 of the bag body 10. In other words, the temporary waste cavity 201 is formed at a portion of the waste collecting cavity 12. It is worth mentioning that the scraper arms 21 are flipped upside-down that the scraping teeth 21 of each of the scraper arms 21 are pointing downward at the opening of the temporary waste cavity 201, as shown in FIG. 2.

In particular, the temporary waste cavity 201 is formed at the bottom portion of the waste collecting cavity 12. Preferably, the second bag portion 14 of the bag body 10 is formed at the upper portion thereof between the scraper arms 21 and the top opening 11 of the bag body 10 as shown in FIGS. 1 and 2. Therefore, the volume of the temporary waste cavity 201 is about two-third of the waste collecting cavity 12. It is appreciated that when the scraper arms 21 are located between the top opening 11 and the bottom of the bag body 10, the volume of the temporary waste cavity 201 is about two-third of the waste collecting cavity 12. Preferably, the volume of the temporary waste cavity 201 is at least half of the waste collecting cavity 12.

The scraper arms 21 are moved toward each other to enclose the temporary waste cavity 201 within the first bag portion 13 of the bag body 10. When moving the scraper arms 21 toward each other, i.e. the scraper arms 21 are moved alongside with each other, the scraper arms 21 are also arranged for scraping the waste within the temporary waste cavity 201, as shown in FIGS. 3B and 3C. In other words, when the bag body 10 is reversibly flipped inside out from the top opening 11, the scraper arms 21 are formed along an opening of the temporary waste cavity 201. Therefore, when the scraper arms 21 are moved toward each other to enclose the temporary waste cavity 201. Through the scraping teeth 211 at each of the scraper arms 21, the scraper arms 21 can easily scrape the pet waste into the temporary waste cavity 201 and to close the temporary waste cavity 201 at the same time. It is worth mentioning that the scraping teeth 211 of the scraper arms 21 are formed along the opening of the temporary waste cavity 201. Therefore, the bag body 10 is then flipped back for automatically retaining the pet waste in the waste collecting cavity 12 from the temporary waste cavity 201, as shown in FIG. 3E.

As shown in FIGS. 1 and 2, the bag body 10 further comprises a drawstring 15 extended around the top opening 11 for tie-closing the waste collecting cavity 12 after the pet waste is collected therein.

In order to move the scraper arms 21, the waste collecting apparatus 20 further comprises a scraping actuator 22 detachably coupled with the scraper arms 21 to drive the scraper arms 21 for picking up the pet waste into the temporary waste cavity 201. As shown in FIG. 1, the scraping actuator 22 comprises two actuator arms 221 pivotally coupled with each other, wherein each of the actuator arms 221 has a detachable end detachably coupled with a free end portion 210 of the scraper arm 21, such that when the actuator arms 221 are pivotally moved, the scraper arms 21 are driven to move toward each other and away from each other. It is worth mentioning that the scraper arms 21 are affixed to the bag body 10 except the free end portions 210 of the scraper arms 21. Therefore, the detachable ends of the actuator arms 221 can be detachably coupled at the free end portions 210 of the scraper arms 21 respectively. In addition, the free end portion 210 of each of the scraper arms 21 is an angled end portion, wherein an angle between an elongated body of the scraper arm 21 and the free end portion 210 is an obtuse angle. Preferably, each of the actuator arms 221 also has an angled end to detachably couple at the free end portion 210 of the scraper arm 21, as shown in FIG. 1. Alternatively, each of the actuator arms 221 can be an elongated straight arm to detachably couple at the free end portion 210 of the scraper arm 21, as shown in FIG. 2. Therefore, the actuator arms 221 are upwardly and inclinedly extended from the opening of the temporary waste cavity 201 when the scraping actuator 22 detachably coupled with the scraper arms 21. In other words, the user is able to easily actuate the scraping actuator 22 to drive the scraper arms 21 for picking up the pet waste on the ground without touching the ground.

Preferably, the two actuator arms 221 are pivotally coupled with each other end-to-end via a spring-loaded pivot joint 222 to form the scraping actuator 22 with a V-shaped configuration. In other words, each of the actuator arms 221 further has an opposed pivot end, wherein the pivot ends of the actuator arms 221 are pivotally coupled by the spring-loaded pivot joint 222 and the detachable ends of the actuator arms 221 are detachably coupled with the free ends of the scraper arms 21 respectively. Therefore, when the user holds the actuator arms 221 and applies a compression force thereto, the scraper arms 21 are driven to move toward each other. Once the compression force is released, the spring-loaded pivot joint 222 will push the actuator arms 221 pivotally moved away from each other so as to move the scraper arms 21 away from each other.

Likewise, the two actuator arms 221' are pivotally coupled with each other via a pivot joint 222' to form the scraping actuator 22' with a scissor-like configuration, such that the user is able to operate the actuator arms 221' to move the scraper arms 21 toward each other and away from each other. Preferably, each of the actuator arms 221' also has an angled end to detachably couple at the free end portion 210 of the scraper arm 21, as shown in FIG. 1. It is worth mentioning that after collecting the pet waste in the bag body 10, the scraping actuator 22, 22' can be detached from the scraper arms 21, such that the scraping actuator 22 is reusable to couple with another set of scraper arms 21 at the bag body 10.

As shown in FIGS. 3A to 3F, a method for collecting the pet waste by the pet waste collector is illustrated, where the method comprises the following steps.

Figure 3A:
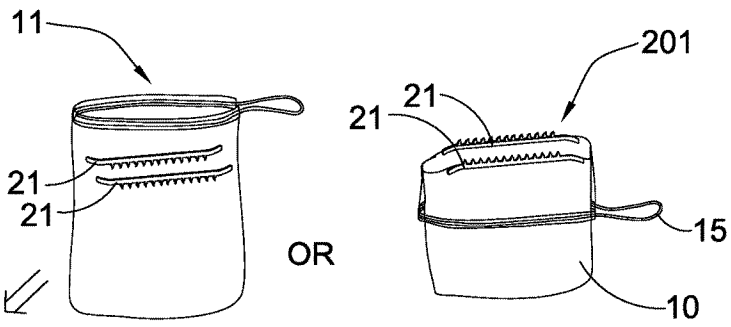
FIGS. 3A to 3F illustrate a method for picking up and collecting the pet waste by the pet waste collector according to the above preferred embodiment of the present invention.
Figure 3B:
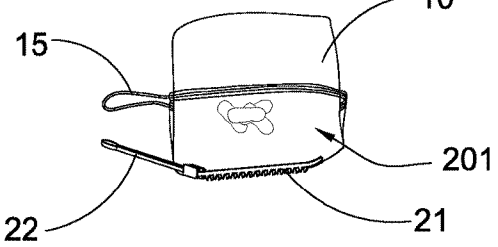
Figures 3C, 3D, 3E, 3F:
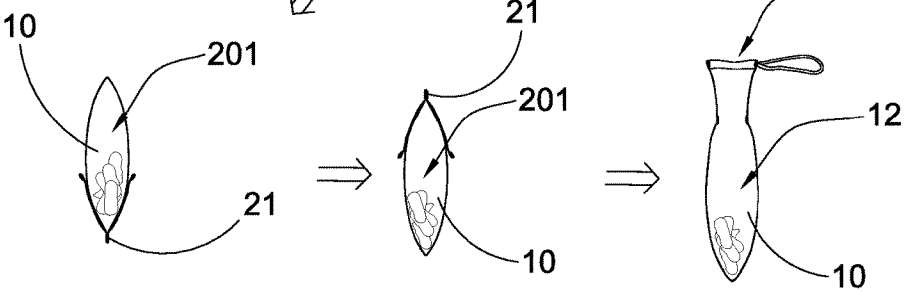

(1) Provide the bag body 10 with two elongated scraper arms 21 spacedly built-in with the bag body 10 to partition the bag body 10 into the first bag portion 13 and the second bag portion 14, as shown in FIG. 3A. Accordingly, the temporary waste cavity 201 is formed at the first bag portion 13 of the bag body 10 within the waste collecting cavity 12 thereof.

(2) Reversibly flip the bag body 10 inside out from the top opening 11. Accordingly, the second bag portion 14 of the bag body 10 is overlapped with and covered by the first bag portion 13, as shown in FIG. 3A, to form the temporary waste cavity 201 within the first bag portion 13 of the bag body 10. In other words, the temporary waste cavity 201 will be exposed when the bag body 10 is flipped. Thus, the scraper arms 21 are formed along an opening of the temporary waste cavity 201. Preferably, the scraping actuator 22 is detachably coupled to the scraper arms 21 before the bag body 10 is flipped to expose the temporary waste cavity 201.

It is worth mentioning that the bag body 10 can be a folded in a compact size. In particular, the bag body 10 can be formed with its original shape as shown in FIG. 3A, such that the user is able to reversibly flip the bag body 10 before it is used. Likewise, the bag body 10 can be pre-folded with the flipped shape as shown in FIG. 3A, such that the user is able to use the flipped bag body 10 right the way.

(3) Scrape the pet waste by moving the scraper arms 21 toward each other to collect the pet waste within the temporary waste cavity 201, as shown in FIG. 3C. Accordingly, the bag body 10 is placed upside-down at a position that the opening of the temporary waste cavity 201 is facing downwardly toward the pet waste. When the scraper arms 21 are moved toward each other, the temporary waste cavity 201 is closed by the scraper arms 21. The scraping teeth 21 of the scraper arms 21 will help to scrape the pet waste from the ground into the temporary waste cavity 201. It is worth mentioning that the user is able to actuate the scraping actuator 22 to move the scraper arms 21 toward each other, as shown in FIG. 3B.

(4) Flip the bag body 10 back for automatically retaining the pet waste in the waste collecting cavity 12 from the temporary waste cavity 201, as shown in FIGS. 3D and 3E. Once the temporary waste cavity 201 is closed by the scraper arms 21 to store the pet waste in the temporary wastes cavity 210, the user is able to place the bag body 10 at a position that the opening of the temporary waste cavity 201 is facing upward, such that the pet waste will be dropped at the bottom of the bag body 10. Then, the user is able to flip the bag body 10 back to its original condition by unfolding the second bag portion 14 of the bag body 10 from the first bag portion 13, as shown in FIGS. 3D and 3E. Then the pet waste will be collected in the waste collecting cavity 12. It is worth mentioning that when flipping the bag body 10, the user is able to hold the scraping actuator 22 to carry the bag body 10 and to maintain the temporary wastes cavity 210 in a closed condition at the same time. Therefore, the closed temporary wastes cavity 210 will reduce the smell of the pet waste to escape therefrom and will keep the second bag portion 14 of the bag body 10 clean.

(5) Tie-close the waste collecting cavity 12 by the drawstring 15 extended around the top opening 11 after the pet waste is collected in the waste collecting cavity 12, as shown in FIG. 3F. It is worth mentioning that the user is able to hold the scraping actuator 22 to carry the bag body 10 and to pull the drawstring 15 for closing the waste collecting cavity 12 at the same time. Therefore, the hand of the user will not touch any portion of the bag body except the drawstring 15. Once the waste collecting cavity 12 is closed by the drawstring 15, the scraping actuator 22 can be detached from the scraper arms 21. Since the scraping actuator 22 will not touch the pet waste during the scraping operation, the user can keep the scraping actuator 22 clean.

It is worth mentioning that the scraper arms 21 can be optionally removed from the bag body 10 after the waste collecting process is completed. The user is able to simply detach the scraper arms 21 from the bag body 10 or to keep the scraper arms 21 at the bag body 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pet waste collector, comprising:

a bag body, which is made of flexible material, comprising two bag sheets overlapped with each other to form a waste collecting cavity therebetween and having a top opening; and a waste collecting apparatus which comprises two elongated scraper arms affixed at said bag sheets respectively so as to spacedly provide at two sides of said bag body to partition said bag body into a first bag portion between said scraper arms and a second bag portion as the rest portion of said bag body, wherein when said bag body is reversibly flipped inside out from said top opening while said two scraper arms are exposed outside to form a temporary waste cavity within said first bag portion of said bag body, said scraper arms are able to be moved toward each other for enclosing said temporary waste cavity within said first bag portion of said bag body and for scraping a pet waste within said temporary waste cavity, such that said bag body is flipped back for automatically retaining the pet waste in said waste collecting cavity from said temporary waste cavity.

2. The pet waste collector, as recited in claim 1, wherein said scraper arms are affixed at two inner sides of said bag sheets respectively, wherein when said bag body is reversibly flipped inside out from said top opening until said two scraper arms are exposed outside, said temporary waste cavity within said first bag portion of said bag body is formed.

3. The pet waste collector, as recited in claim 2, wherein said scraper arms are parallel with each other.

4. The pet waste collector, as recited in claim 2, wherein said scraper arms are affixed to said bag body with a distance away from said top opening.

5. The pet waste collector, as recited in claim 2, wherein each of said scraper arms has a plurality of scraping teeth formed along a longitudinal edge thereof for enhancing a scraping operation when said scraper arms are moved toward each other.

6. The pet waste collector, as recited in claim 5, wherein said scraping teeth of each of said scraper arms are pointing toward a bottom of said bag body.

7. The pet waste collector, as recited in claim 5, wherein said scraping teeth are formed in a curved shape to serve as clawing teeth.

8. The pet waste collector, as recited in claim 1, wherein said scraper arms are parallel with each other.

9. The pet waste collector, as recited in claim 1, wherein said scraper arms are affixed to said bag body with a distance away from said top opening.

10. The pet waste collector, as recited in claim 1, wherein each of said scraper arms has a plurality of scraping teeth formed along a longitudinal edge thereof for enhancing a scraping operation when said scraper arms are moved toward each other.

11. The pet waste collector, as recited in claim 10, wherein said scraping teeth of each of said scraper arms are pointing toward a bottom of said bag body.

12. The pet waste collector, as recited in claim 1, wherein said waste collecting apparatus further comprises a scraping actuator detachably coupled with said scraper arms, wherein said scraping actuator comprises two actuator arms pivotally coupled with each other and detachably coupled with free ends of said scraper arms respectively, such that when said actuator arms are pivotally moved, said scraper arms are driven to move toward each other.

13. The pet waste collector, as recited in claim 2, wherein said waste collecting apparatus further comprises a scraping actuator detachably coupled with said scraper arms, wherein said scraping actuator comprises two actuator arms pivotally coupled with each other and detachably coupled with free ends of said scraper arms respectively, such that when said actuator arms are pivotally moved, said scraper arms are driven to move toward each other.

14. The pet waste collector, as recited in claim 13, wherein said actuator arms are pivotally coupled with each other via a spring-loaded pivot joint.

15. The pet waste collector, as recited in claim 13, wherein said free end of each of said scraper arms is an angled free end.

16. A method for collecting pet waste by a pet waste collector, comprising the steps of:

(a) spacing apart two elongated scraper arms affixed at two bag sheets of a bag body, which is formed by overlapping said two bag sheets, respectively so as to spacedly provide at two sides of said bag body respectively, wherein said two scraper arms are positioned away from a top opening to partition said bag body into a first bag portion between said scraper arms and a second bag portion as the rest portion of said bag body;

(b) reversibly flipping said bag body inside out from said top opening while exposing said two scraper arms outside to form a temporary waste cavity within said first bag portion of said bag body;

(c) driving said scraper arms towards each other with a scraping actuator to scrape the pet waste to collect the pet waste within said temporary waste cavity; and (d) flipping said bag body back for automatically retaining the pet waste in said waste collecting cavity from said temporary waste cavity.

17. The method, as recited in claim 16, wherein said scraping actuator comprises two actuator arms and the step (c) further comprises a step of detachably coupling said scraper arms with said two actuator arms of said scraping actuator respectively.

18. The method, as recited in claim 17, wherein said two actuator arms are pivotally coupled with each other and detachably coupled with free ends of said scraper arms respectively, such that when said actuator arms are pivotally moved, said scraper arms are driven to move toward each other.

19. The method, as recited in claim 16, further comprising a step of tie-closing said waste collecting cavity by a drawstring extended around said top opening after the pet waste is collected in said waste collecting cavity.

* * * * *